United States Patent [19]

Atkinson

[11] Patent Number: 4,705,929

[45] Date of Patent: Nov. 10, 1987

[54] MICROWAVE TRAYS

[75] Inventor: William G. Atkinson, London, Canada

[73] Assignee: Somerville Belkin Industries Inc., London, Canada

[21] Appl. No.: 942,994

[22] Filed: Dec. 18, 1986

[51] Int. Cl.[4] ..... H05B 6/80

[52] U.S. Cl. ..... 219/10.55 E; 219/10.55 M

[58] Field of Search ..... 219/10.55 R, 10.55 E, 219/10.55 M; 426/523

[56] References Cited

U.S. PATENT DOCUMENTS

| | | | |
|---|---|---|---|
| 3,865,301 | 2/1975 | Pothier et al. | 219/10.55 E |
| 3,924,013 | 12/1975 | Kane | 219/10.55 E |
| 4,327,136 | 4/1982 | Thompson et al. | 219/10.55 E |
| 4,555,605 | 11/1985 | Brown et al. | 219/10.55 E |

*Primary Examiner*—J. R. Scott
*Assistant Examiner*—L. K. Fuller
*Attorney, Agent, or Firm*—Fetherstonhaugh & Co.

[57] ABSTRACT

A heating stand for supporting an item which is to be heated in a microwave oven. The stand comprises a boxboard blank having a microwave intereactive layer of material on its upper face. The interactive layer extends continuously between first oppositely disposed edges, and is spaced laterally inwardly from the second side edges thereof to form uncoated margins at each of the second edges of the blank. The blank is creased to provide fold lines which define a platform panel, support leg panels and leg bracing panels. The platform panel is proportioned to provide support for an article to be heated. The support leg panels are foldable along their crease line to project downwardly from the platform in use to support the platform in an elevated position in a microwave oven. The leg bracing panels are foldable along their crease line to project downwardly from the platform in use and are connectable to the support leg panels to rigidifying the support leg panels. The support legs and the bracing panels each have a distal end remote from the support panel. The distal ends of the support legs are formed from the uncoated margins of the blank so as to be inactive when subjected to microwave radiation. The distal ends of the support legs project a substantial distance below the distal ends of the leg bracing panels when in the folded position to support the interactive platform and the interactive leg bracing panels in a spaced relationship with respect to the underlying support surface in use.

4 Claims, 6 Drawing Figures

MICROWAVE TRAYS

This invention relates to the manufacture of heating stands for microwave heating of food items and the like.

In particular, this invention relates to a simple and inexpensive method of making a plurality of heating stands from a longitudinally elongated laminate and the stands produced thereby.

PRIOR ART

A tray suitable for use as a heating stand for microwave heating of food is disclosed in U.S. Pat. No. 4,555,605. This tray includes a support wall and 4 perimetric walls which are hingedly connected to the support wall and which can be erected to form legs which serve to space the support wall from the underlying support surface of the oven. A microwave reactive layer is applied to the upper surface of the support panel and is spaced from the side edges of the support panel and does not extend across any of the perimetric walls. This type of tray would be difficult to produce because it is difficult to accurately position the microwave reactive layer on the support panel. If the microwave reactive layer was misaligned to the extent that it extended to the outer edge of any one of ther perimetric walls, it would come in contact with the underlying support surface of the microwave oven in use and this can cause localized overheating.

It is an object of the present invention to provide a simple and inexpensive method for producing heating stands from an elongated web of boxboard to which a continuous longitudinally elongated web of microwave reactive material is applied.

It is a further object of the present invention to provide a heating stand which has support legs and bracing panels for supporting the load supporting platform in a spaced relationship with respect to the walls of the oven while maintaining a spaced relationship between the microwave reactive coating apolied to the bracing panels.

According to one aspect of the present invention, there is provided a heating stand for supporting an item which is to be heated in a microwave oven comprising a boxboard blank having an upper face, a lower face, a pair of longitudinally spaced first edges and a pair of transversely spaced second edges, a microwave intereactive layer of material on said upper face of said blank, said interactive layer extending continuously between said first edges, said interactive layer being spaced laterally inwardly from said second edges to form uncoated margins at each of said second edges of said blank, said blank being creased to provide fold lines which define a platform panel, support leg panels and leg bracing panels, said platform panel being proportioned to provide support for an article to be heated in use, said support leg panels being foldable along their crease line to project downwardly from said platform in use to support said platform in an elevated position in a microwave oven in use, said leg bracing panels being foldable along their crease line to project downwardly from said platform in use and being connectable to the support leg panels to rigidifying the support leg panels in use, said support legs and said bracing panels each having a distal end remote from said support panel, the distal ends of said support legs being formed from said uncoated margins of said blank so as to be inactive when subjected to microwave radiation, said distal ends of said support legs projecting a substantial distance below the distal ends of said leg bracing panels when in the folded position to support the interactive platform and the interactive leg bracing panels in a spaced relationship with respect to the underlying support surface in use.

According to a further aspect of the present invention, there is provided a method of forming a heating stand for use in a microwave oven or the like comprising applying a longitudinally elongated web of microwave reactive material to a longitudinally elongated first surface of a longitudinally elongated web of boxboard material to form a longitudinally elongated laminate, the microwave reactive web being narrower than the boxboard web, the longitudinal side edges of the microwave reactive web being spaced a substantial distance inwardly from the longitudinal side edges of the boxboard to provide uncoated margins at each longitudinal side edge of said web, said blank being creased to provide fold lines which define a platform panel, support leg panels and leg bracing panels, said platform panel being proportioned to provide support for an article to be heated in use, said support leg panels being foldable along their crease line to project downwardly from said platform in use to support said platform in an elevated position in a microwave oven in use, said leg bracing panels being foldable along their crease line to project downwardly from said platform in use and being connectable to the support leg panels to rigidifying the support leg panels in use, said support legs and said bracing panels each having a distal end remote from said support panel, the distal ends of said support legs being formed from said uncoated margins of said blank so as to be inactive when subjected to microwave radiation, said distal ends of said support legs projecting a substantial distance below the distal ends of said leg bracing panels when in the folded position to support the interactive platform and the interactive leg bracing panels in a spaced relationship with respect to the underlying support surface in use.

The invention will be more clearly understood after reference to the following detailed specification read in conjunction with the drawings wherein.

Figure 1:
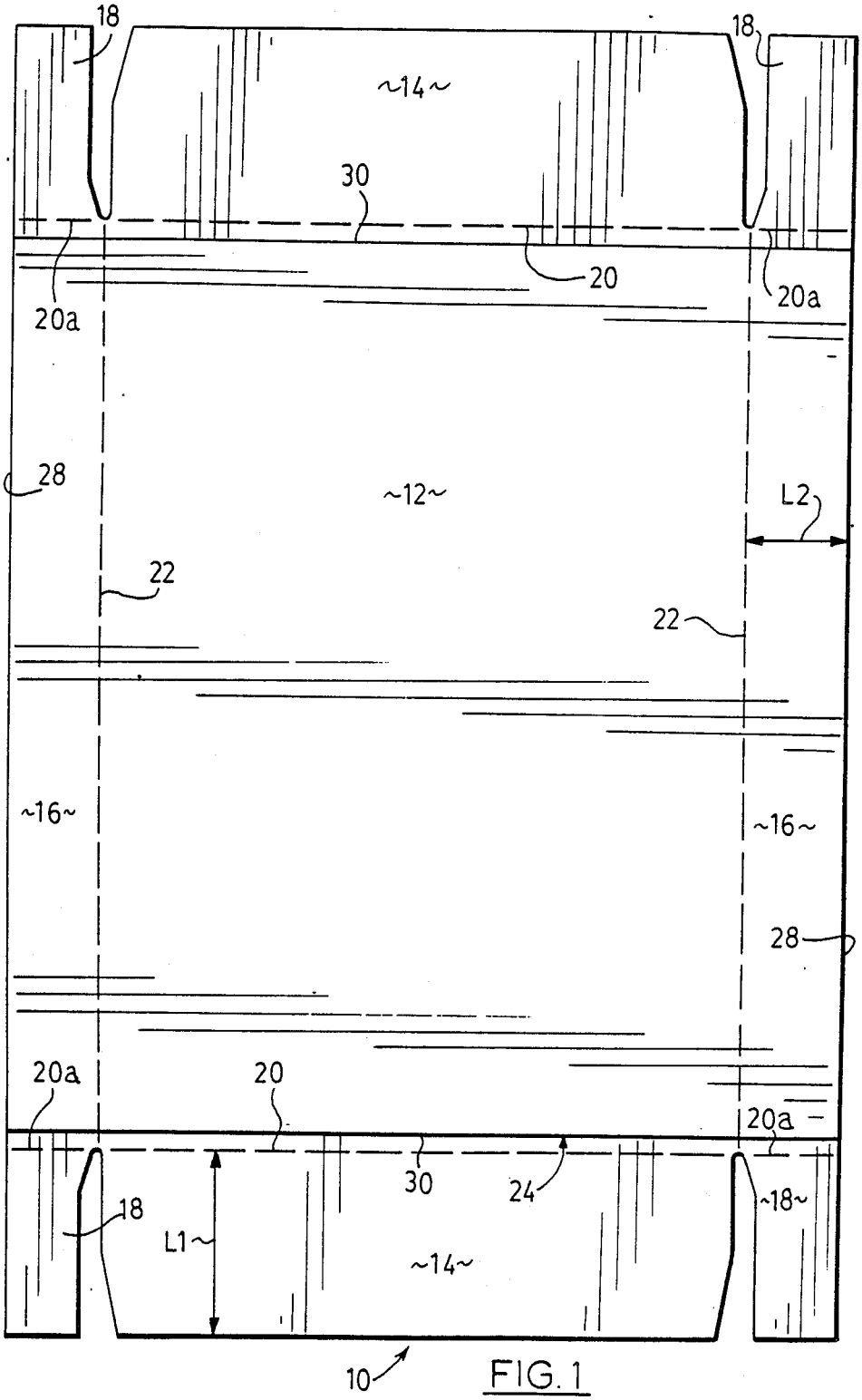
FIG. 1 is a plan view of a blank suitable for use in forming a heating stand constructed in accordance with an embodiment of the present invention.

With reference to FIG. 1 of the drawings, the reference numeral 10 refers generally to a blank suitable for use in forming a heating stand in accordance with an embodiment of the present invention.

The blank 10 comprises a platform panel 12, a pair of leg support panels 14, a pair of bracing panels 16 and four locking lugs 18. The leg support panels 14 are hingedly connected one to each first side edge of the platform panel 12 along longitudinally extending hinge lines 20, the locking lugs 18 are hingedly connected to opposite ends of the bracing panels 16 a long hinge lines 20, 20*a*.

The bracing panels 16 are hingedly connected to second side edges of the platform panel along transverse hinge lines 22.

A layer of microwave reactive material 24 is located on the upper surface of the platform panel 12 and bracing panels 16 and extends continuously between the edges 28 of the bracing panels 16. The oppositely disposed longitudinal edges 30 of the microwave reactive material 24 are spaced laterally inwardly from the longitudinal crease lines 20, 20*a*.

It will be noted that the length L1 of the leg support panels 14 is substantially greater than the length L2 of the platform panel 12.

Figure 2:
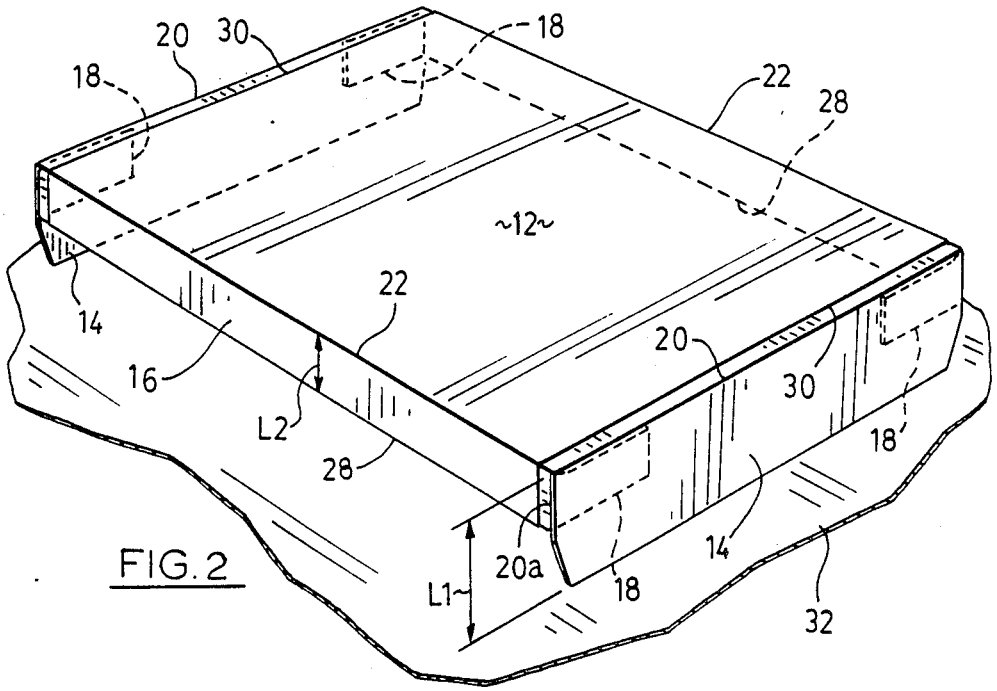
FIG. 2 is a pictorial view of a support stand formed from the blank of FIG. 1.

As shown in FIG. 2 of the drawings, when the heating stand is erected, the bracing panels 16 are folded along the fold lines 22 to extend perpendicular to the platform panel 12. The locking lugs 18 are folded along the hinge lines 20*a* to extend perpendicular to the bracing panels 16. The leg support panels are folded along the hinge lines 20 to extend perpendicular to the platform panel 12 and to overlie the locking lugs 18. The locking lugs 18 are secured by an adhesive or the like to the leg support panels 14 to retain the leg support panels in an upright position. It will be noted that because the length L1 of the support legs is greater than the length L2 of the bracing panels, the lower edge 28 of the bracing panels will be spaced a substantial distance above the underlying support surface 32 of the microwave oven in use.

Figure 3:
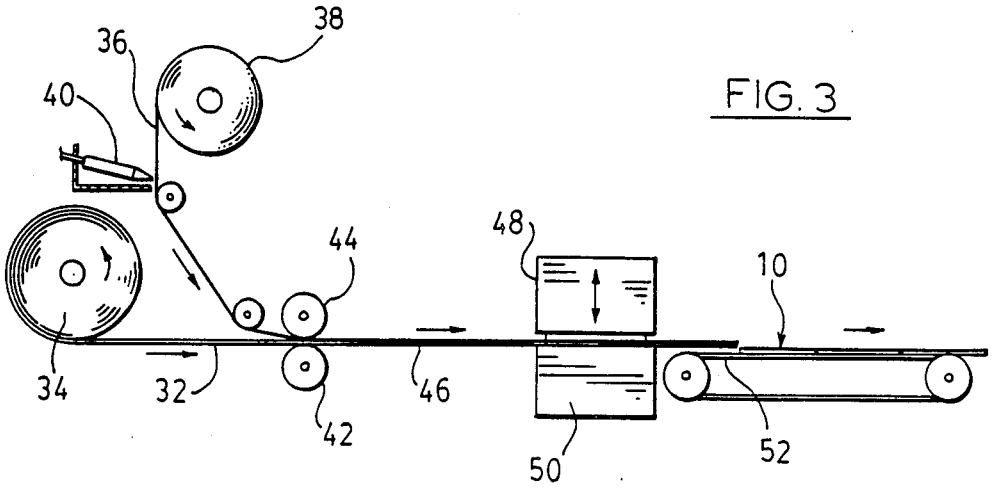
FIG. 3 is a diagrammatic side view of a laminating and blank manufacturing mechanism.

The method of manufacturing the blanks 10 will now be described with reference to FIGS. 3 and 4 of the drawings. As shown in FIG. 3 of the drawings, a longitudinally elongated web 32 of boxboard material is unwound from a coil 34. Simultaneously, a web 36 of microwave reactive material 36 is unwound from a coil 38. Adhesive is applied to a face of the web 36 by an adhesive applicator 40. Nip rollers 42 and 44 serve to press the webs 32 and 36 together to form a laminate 46. The laminate 46 passes between cutting dies 48 and 50 and the separated blanks 10 are accumulated on a loading conveyor 52.

Figure 4:
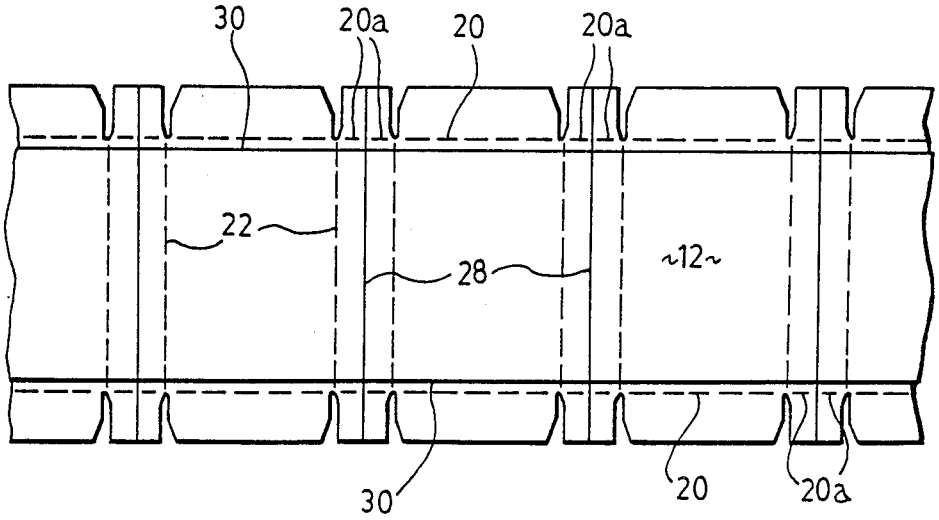
FIG. 4 is a plan view of an elongated laminate showing the various cutouts and creaselines formed in the die cutting press.

The cutting dies 48 and 50 cooperate with one another to form the various crease lines and cuts shown in FIG. 4 of the drawings.

It will be noted that the microwave reactive web and the web of boxboard material are formed to provide a simple laminate in which it is only necessary to ensure that the longitudinal side edges 30 are aligned with and spaced inwardly from the crease lines 20, 20*a*. There is no need to take any special steps in order to obtain longitudinal registration of the microwave reactive web with respect to the boxboard web.

Figure 6:
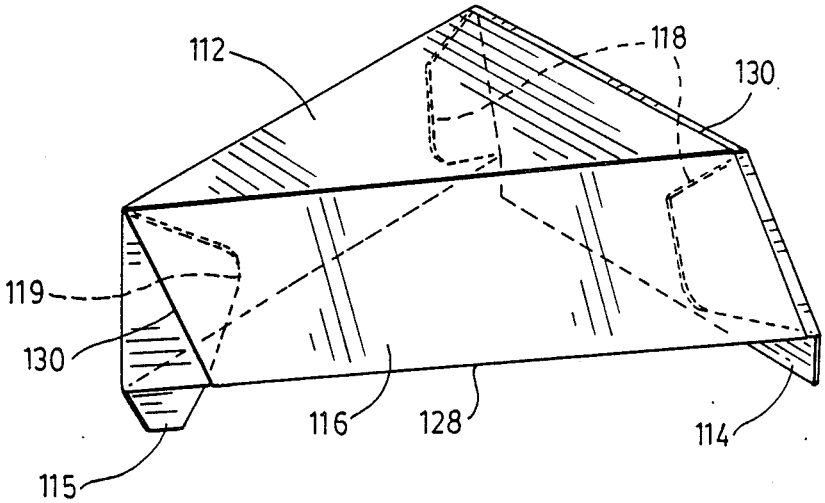
FIG. 6 is a pictorial view of a support stand formed from the blanks of FIG. 5.
Figure 5:
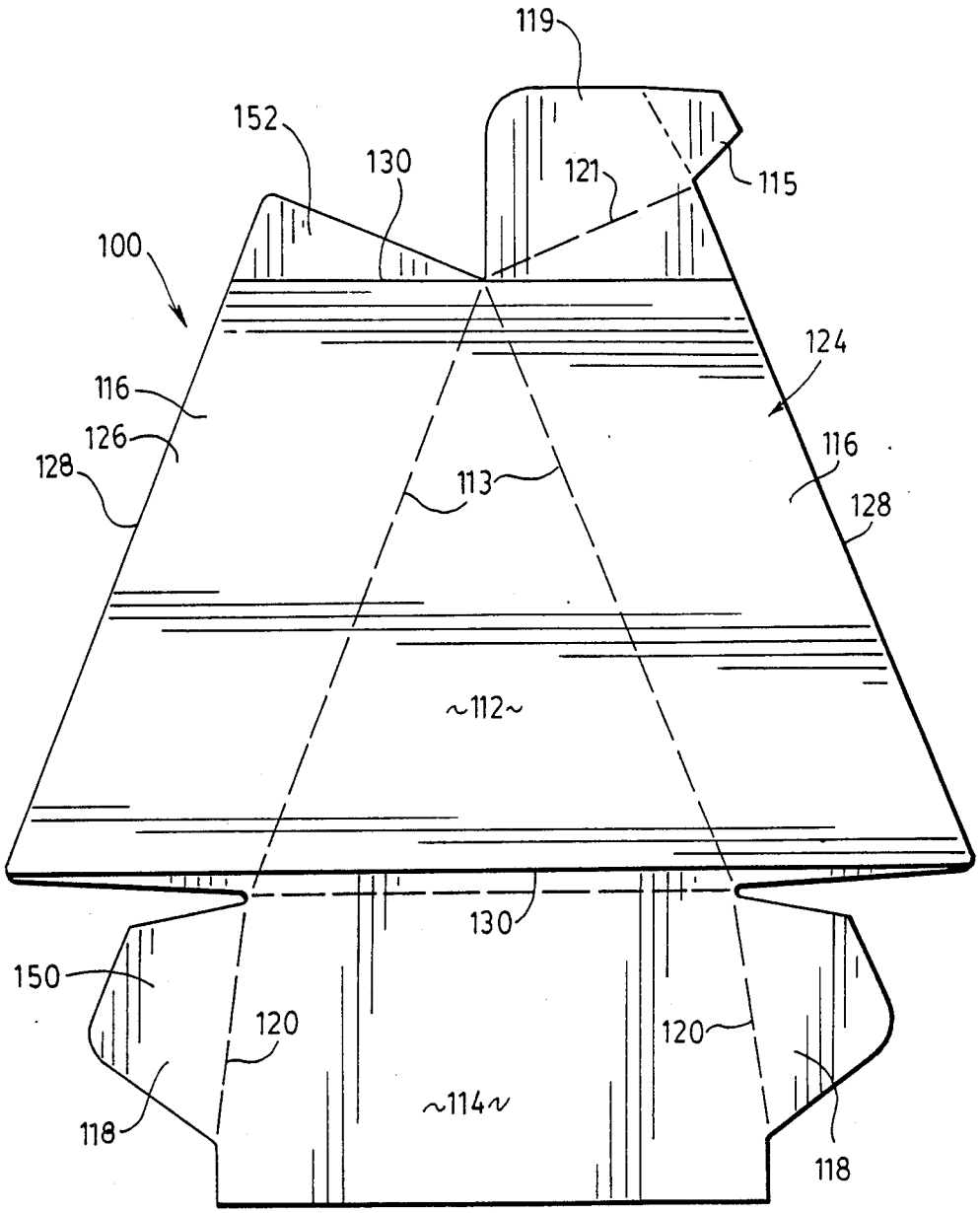
FIG. 5 is a pictorial view of a blank constructed in accordance with a further embodiment of the present invention.

Various modifications of the heating stand of the present invention will be apparent to those skilled in the art. One such modification is illustrated in FIGS. 5 and 6 of the drawings wherein the blank 100 comprises a platform panel 112, a leg support panel 114, a leg support panel 115, a pair of bracing panels 116 and locking lugs 118 and 119. The locking lugs 118 are hingedly connected to opposite ends of the leg support panel 114 along hinge lines 120, the bracing panels 116 are hingedly connected to the support panel 112 along hinge lines 113, the leg support panel 114 is connected to the support panel 112 along hinge line 115, the lug 119 is connected to the brace panel 116 along hinge line 121. The support leg panel 115 projects outwardly from the edge 128 of the adjacent brace panel 116. The layer of microwave reactive material 124 is located on the upper surface 126 of the support panel 112 and bracing panels 116 and extends continuously between the edges 128 of the bracing panels 116. Oppositely disposed longitudinal edges 130 of the microwave reactive material 124 are spaced laterally inwardly from the leg forming panels 114 and 116 to provide uncoated margins 150 and 152 at opposite sides thereof from which the leg support panels 114 and 115 are formed.

With reference to FIG. 6 of the drawings, it will be seen that when the support platform is arranged in the assembled position, the leg support panels 115 and 114 will project below the edges 128 of the bracing panels 116 and will therefore serve to provide inactive support pegs for supporting the microwave reactive layer in a spaced relationship with respect to the underlying surface of a microwave oven or the like in use. The heating stand is retained in the errect position by securing the lugs 119 and 118 to the inner face of an adjacent bracing panel 116 by means of an adhesive or the like.

From the foregoing it will be apparent that the present invention provides a simple and inexpensive method of manufacturing a heating stand suitable for use in association with a microwave oven or the like.

I claim:

1. A heating stand for supporting an item which is to be heated in a microwave oven comprising;

(a) a boxboard blank having an upper face, a lower face, a pair of longitudinally spaced first edges and a pair of transversely spaced second edges, (b) a microwave intereactive layer of material on said upper face of said blank, said interactive layer extending continuously between said first edges, said interactive layer being spaced laterally inwardly from said second edges to form uncoated margins at each of said second edges of said blank, (c) said blank being creased to provide fold lines which define a platform panel, support leg panels and leg bracing panels, said platform panel being proportioned to provide support for an article to be heated, said support leg panels being foldable along their crease line to project downwardly from said platform to support said platform in an elevated position in a microwave oven, said leg bracing panels being foldable along their crease line to project downwardly from said platform and being connectable to the support leg panels to rigidifying the support leg panels, (d) said support legs and said bracing panels each having a distal end remote from said support panel, the distal ends of said support legs being formed from said uncoated margins of said blank so as to be inactive when subjected to microwave radiation, said distal ends of said support legs projecting a substantial distance below the distal ends of said leg bracing panels when in the folded position to support the interactive platform and the interactive leg bracing panels in a spaced relationship with respect to the underlying support surface.

2. A heating stand for supporting an item which is to be heated in a microwave oven comprising:

(a) a paperboard blank having an upper face and a lower face, said blank comprising;

(i) a platform panel having a first pair of side edges and a second pair of side edges, (ii) support leg panels located at opposite ends of said platform panel and hingedly connected one to each first side edge of said platform panel, said leg panels being moveable relative to the platform between a first coplanar position and a second upright position extending downwardly from said platform panel, each of said leg panels having a lower end when located in said upright position, (iii) a pair of bracing panels hingedly connected one to each second side edge of said platform for movement relative to the platform panel between a first coplanar position and a second downwardly extending position, said bracing panels having a lower end when located in said downward extending position, said bracing panels being connected to the leg panels when in the downwardly extending position to retain the leg panels in their upright position and to support the platform panel in its load supporting configuration, (b) a layer of microwave interactive material on said upper face of said blank, said layer extending continuously along the upper face of the blank from the lower end of one bracing panel to the lower end of the other bracing panel, (c) said leg panels being longer than said bracing panels so as to support the lower ends of the bracing panels in a spaced relationship from the underlying surface of the microwave oven to prevent contact between the microwave reactive layer and the surface of the oven in use.

3. A method of forming a heating stand for use in a microwave oven or the like comprising;

(a) applying a longitudinally elongated web of microwave reactive material to a longitudinally elongated first surface of a longitudinally elongated web of boxboard material to form a longitudinally elongated laminate, the microwave reactive web being narrower than the boxboard web, the longitudinal side edges of the microwave reactive web being spaced a substantial distance inwardly from the longitudinal side edges of the boxboard, (to provide uncoated margins at each longitudinal side edge of said web, said blank being creased to provide fold lines which define a platform panel, support leg panels and leg bracing panels, said platform panel being proportioned to provide support for an article to be heated in use, said support leg panels being foldable along their crease line to project downwardly from said platform panel in use to support said platform in an elevated position when in a microwave oven, said leg bracing panels being foldable along their crease line to project downwardly from said platform pane and being connectable to the support leg panels to rigidify the support leg panels, said support leg panels and said leg bracing panels each having a distal end remote from said platform panel, the distal ends of said support leg panels being formed from said uncoated margins of said blank so as to be inactive when subjected to microwave radiation, said distal ends of said support leg panels projecting a substantial distance below the distal ends of said leg bracing panels when in the folded position to support the platform panel and the leg bracing panels in a spaced relationship with respect to the underlying support surface.

4. A method of forming a heating stand for use in a microwave oven or the like comprising;

(a) applying a longitudinally elongated web of microwave reactive material to a longitudinally elongated first surface of a longitudinally elongated web of boxboard material to form a longitudinally elongated laminate, the microwave reactive web being narrower than the boxboard web, the longitudinal side edges of the microwave reactive web being spaced a substantial distance inwardly from the longitudinal side edges of the boxboard, (b) creasing and cutting the laminate to form a plurality of heat stand blanks from serially connected sections of said elongated laminate, said laminate being creased and cut to form a central platform panel, a pair of leg panels hingedly connected to the platform panel along a first pair of hinge lines which extend longitudinally of the web, each of said leg panels having a length extending perpendicularly from a first hinge line, a pair of bracing panels connected to the platform panel along a second pair of hinge lines which extends transversely to the web, each bracing panel having a length extending perpendicularly from its associated second hinge line, the length of each leg panel being substantially greater than the length of each bracing panel, such that when the leg panels are arranged in an upright position in use, they support the bracing panels and the platform in a spaced relationship with respect to the underlying surface and thereby prevent contact between the microwave reactive web and the support surface.

* * * * *